US006030469A

United States Patent [19]

Ernst et al.

[11] Patent Number: 6,030,469

[45] Date of Patent: Feb. 29, 2000

[54] FULLY MARTENSITIC STEEL ALLOY

[75] Inventors: Peter Ernst, Stadel; Peter Uggowitzer, Ottenbach; Markus Speidel, Birmenstorf; Alkan Göcmen, Baden-Dättwil, all of Switzerland

[73] Assignee: ABB Research Ltd., Zurich, Switzerland

[21] Appl. No.: 09/044,784

[22] Filed: Mar. 20, 1998

[30] Foreign Application Priority Data

Mar. 21, 1997 [DE] Germany ..... 197 12 020

[51] Int. Cl.[7] ..... C22C 38/30; C22C 38/52; C21D 6/00

[52] U.S. Cl. ..... 148/325; 148/333; 148/663; 148/654; 420/38; 420/107

[58] Field of Search ..... 148/325, 333, 148/663, 654; 420/36–38, 70, 109, 107

[56] References Cited

U.S. PATENT DOCUMENTS 5,310,431 5/1994 Buck .
5,415,706 5/1995 Scarlin et al. ..... 148/325

FOREIGN PATENT DOCUMENTS

4212966 A1 10/1993 Germany .
8-225833 9/1996 Japan .
796733 6/1958 United Kingdom .

OTHER PUBLICATIONS

Goecmen et al., "Precipitation Behaviour and Stability of Nitrides in High Nitrogen Martensitic 9% and 12% Chromium Steels", ISIJ International, vol. 36, No. 7 (1996), pp. 768–776.

*Primary Examiner*—Deborah Yee
*Attorney, Agent, or Firm*—Burns, Doane, Swecker & Mathis, L.L.P.

[57] ABSTRACT

A fully martensitic quenching and tempering steel (AP) essentially consists of (measured in % by weight): 8 to 15% of Cr, up to 15% of Co, up to 4% of Mn, up to 4% of Ni, up to 8% of Mo, up to 6% of W, 0.5 to 1.5% of V, up to 0.15% of Nb, up to 0.04% of Ti, up to 0.4% of Ta, up to 0.02% of Zr, up to 0.02% of Hf, at most 50 ppm of B, up to 0.1% of C and 0.12–0.25% of N, the content of Mn+Ni being less than 4% and the content of Mo+W being less than 8%, the remainder being iron and usual impurities resulting from smelting.

20 Claims, 6 Drawing Sheets

FULLY MARTENSITIC STEEL ALLOY

This application claims priority under 35 U.S.C. §§119 and/or 365 to No. 197 12 020.2 filed in Germany on Mar. 21, 1997; the entire content of which is hereby incorporated by reference.

BACKGROUND OF THE INVENTION

1. Field of the Invention

The invention relates to novel alloy specifications from the class of fully martensitic 9–15% chrome steels. By means of a controlled precipitation sequence in the quenching phase, excellent properties and property combinations for wide applications in the power station field can be provided.

2. Discussion of Background

Fully martensitic quenching and tempering steels with 9–12% of chromium are widely used materials in power station engineering. Properties of interest for high-temperature applications are their low manufacturing costs, their low thermal expansion and their high thermal conductivity.

The mechanical properties important for the use are produced by a so-called quenching and tempering process. It is carried out by a solution-annealing treatment, a quenching treatment and a subsequent tempering treatment in a moderate temperature range. The resulting microstructure is distinguished by a dense arrangement of laths with integral precipitation phases. These microstructures are unstable at elevated temperatures. They soften as a function of time, of stress and of the deformations forced on them. The phase reactions proceeding during the heat treatment restrict the achievable ductility within the scope of the demanded strengths. The phase reactions proceeding during operation together with the coarsening of the precipitations cause an increased susceptibility to embrittlement and reduce the expansions to which the components are subjected.

As a consequence of these structural instabilities during the heat treatment and in operation, the current alloys from the class of fully martensitic 9–15% chrome steel no longer meet the requirements of modern power station engineering. This applies primarily to the combination of strength and ductility, and also to combinations of high-temperature strength, creep resistance, creep rupture strength, relaxation strength, resistance to creep embrittlement and thermal fatigue. Narrow metallurgical limits for a steady improvement in the properties of this alloy class are set by the requirement of a capacity for full quenching and tempering, in particular in thick-walled components.

Within the scope of the restricted metallurgical possibilities, further improvements in the properties and property combinations are mainly achieved only if an enhanced stability of the microstructural states being formed in the individual heat treatment phases is obtained by the alloying measures taken. This includes in particular an increased resistance to grain coarsening at increased solution-annealing temperatures, improved hardenability during quenching and increased resistance to softening during the final tempering treatment (tempering resistance).

In the industrially known and newly launched alloys, an optimum combination of grain coarsening resistance, hardenability and tempering resistance is achieved by a suitable (empirical) matching of vanadium, niobium, carbon and nitrogen. Optimum combinations are obtained when the carbon content in atom percent is higher than that of nitrogen. The optimum carbon content is in the range of 0.1–0.2% by weight and the optimum nitrogen content is in the range of 0.05–0.1% by weight. In order to achieve a maximum tempering resistance coupled with a high grain coarsening resistance, nitrogen is alloyed in almost stoichiometric proportions with the alloy nitride formers vanadium or niobium. The optimum content of vanadium is consequently in the range of 0.2–0.35%. by weight and that of niobium is in the range of 0.05–0.4% by weight. The state of the art is well represented by the earlier alloys X22CrMoV121 (X22), X20CrMoV121, X12CrNiMo2, X19CrMoVNbN111 (X19) and by the more recent alloys X10CrMoVNbN91 (P/T91), X12CrMoWVNbN1011 (rotor steel E2), X18CrMoVNbNB91 (rotor steel B2) and by the alloy X20CrMoVNbNB10 1 (TAF).

SUMMARY OF THE INVENTION

Accordingly, one object of the invention is to identify novel alloy specifications for the formation of fully martensitic structures, in which a controlled dissolution and reprecipitation of alloy nitrides or alloy carbonitrides together with the martensitic phase transformation leads to the top properties and property combinations, without the properties and property combinations to be achieved being restricted by the size of the components which are to be quenched and tempered. These specifications distinguished by the composition and heat treatment are then applied not only in the field of thin-walled components such as pipes, bolts and blades, but also for rotors, rotor wheels, the most diverse casing components, boiler installations and many more.

The core of the invention are specifications of alloy compositions and heat treatment parameters, which make it possible for alloy nitrides or alloy carbonitrides to be reprecipitated again in a very effective volume, even before the martensitic phase transformation has taken place by partial dissolution in very high solution-annealing temperatures. Since thermally very stable alloy nitrides or alloy carbonitrides are concerned, which form a generally high resistance to coarsening, high resistance to grain coarsening at high solution-annealing temperatures is ensured, and the reprecipitation of these particles can be exploited for maximum strengthening during the martensitic phase transformation even in the case of the slow cooling rates prevailing in industry in the case of thick-walled components. By means of such a cooling process, the susceptibility to softening and embrittlement at increased tempering temperatures and/or tempering times is markedly reduced. The microstructure resulting after the tempering treatment is distinguished by a very uniform and dense dispersion of alloy nitrides and/or alloy carbonitrides, which have been precipitated already before the martensitic phase transformation, in a lath structure. The identified alloy compositions thus confer not only an optimum combination of grain coarsening resistance, hardenability and tempering resistance, but also permit a targeted influence on the martensitic phase transformation by means of precipitation phases for the purpose of improved mechanical properties and enhanced microstructure stability in operation.

Specifications of the composition, in which these phase reactions can be exploited for setting enhanced properties and property combinations, contain essentially 8 to 15% of Cr, up to 15% of Co, up to 4% of Mn, up to 4% of Ni, up to 8% of Mo, up to 6% of W, 0.5 to 1.5% of V, up to 0.15% of Nb, up to 0.04% of Ti, up to 0.4% of Ta, up to 0.02% of Zr, up to 0.02% of Hf, up to 0.1% of C and 0.12–0.25% of N, the remainder being iron and usual impurities resulting from smelting. The respective heat treatments, which make a controlled setting of improved property combinations possible, are defined as follows. The solution-annealing treatment preferably takes place at between 1150 and 1250° C. with holding times between 0.5 and 15 hours. The cooling takes place rapidly or slowly under control and is interrupted by isothermal annealing in the temperature range between 900 and 500° C. depending on the requirement and application. The cooling and isothermal annealing can be accompanied by a thermomechanical treatment, depending on the requirement and application. The tempering treatment after quenching takes place in the temperature range between 600 and 820° C. and can take between 0.5 and 30 hours.

The invention leads to a number of advantages. The above-formulated specifications of the alloy composition and of the heat treatment make it possible to adjust the best possible property combinations of strength, ductility, high-temperature strength, relaxation resistance, creep resistance, creep rupture strength, creep ductility, resistance to thermal fatigue and so on. The easy controllability of the precipitation states being established allows an economically efficient development and improvement of products for high-temperature applications. The ageing of the microstructure during operation takes place with a delay due to the uniformity and stability of the precipitation states and thus controls and allows not only extended service lives, but also enhances the reliability of prognoses of the service life of the components in operation. The microstructure formation in thick-walled components such as, for example, in rotors can, by means of influencing and controlling the local cooling rates, be made flexible and optimized in accordance with the stresses. This permits a markedly improved overall optimization of the service life of such components, while taking account of the thermal stresses occurring in them under non-uniform operating conditions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
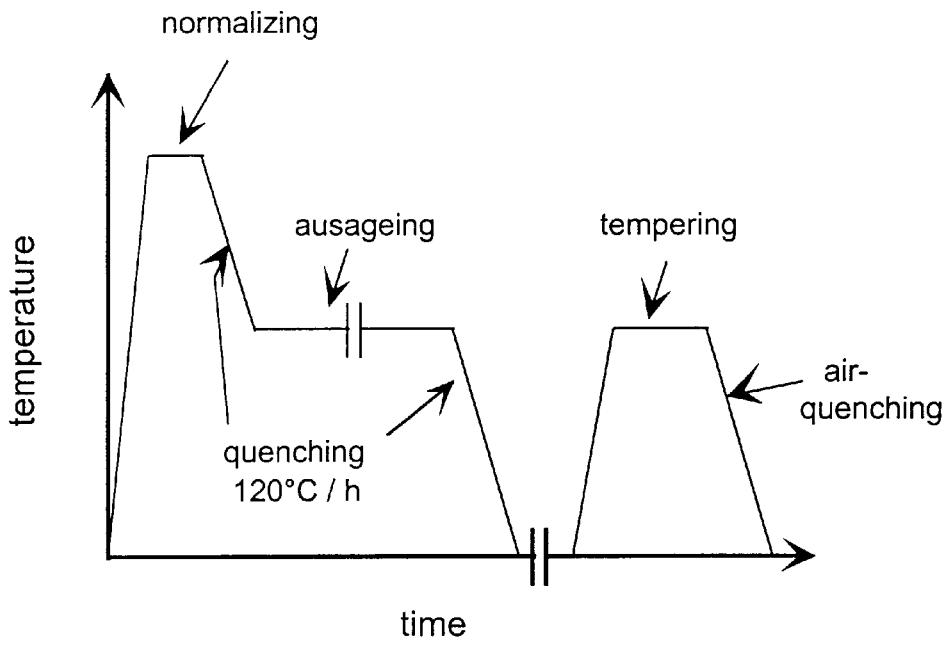
FIG. 1 shows a diagrammatic representation of a heat treatment, characterized by an ausageing treatment.

The specifications developed for the use according to the invention contain essentially 8 to 15% of Cr, up to 15% of Co, up to 4% of Mn, up to 4% of Ni, up to 8% of Mo, up to 6% of W, 0.5 to 1.5% of V, up to 0.15% of Nb, up to 0.04% of Ti, up to 0.4% of Ta, up to 0.04% of Zr, up to 0.04% of Hf, up to 0.1% of C and 0.12–0.25% of N and can be produced by casting or by powder-metallurgical means. Specifications of this type exploit, depending on the intended use, controlled dissolution and reprecipitation reactions of thermodynamically stable alloy nitrides and alloy carbonitrides at high temperatures and before the martensitic phase transformation. As a result, the overall stability of the microstructure fully developing during the tempering treatment and in operation is increased and the mechanical properties as a whole are improved.

Known and industrially accepted, fully martensitic 9–12% chrome steels are in most cases rich in carbon and achieve their effect by a tempered microstructure in which chromium carbides of the $M_{23}(C,N)$ and $M_2(C,N)$ types provide the highest contribution to the total precipitation volume. These precipitation phases are susceptible to rapid coarsening and agglomeration within the heterogeneous martensitic phase microstructure and are therefore not only very restricted in their effect on the strength but at the same time also effect a reduction in the ductility. Their volume contributions can be reduced in favor of an increased precipitation volume of so-called alloy carbonitrides, provided that the specifications are enriched in corresponding alloy carbonitride formers such as, for example, Nb, Ti, Ta, Zr and Hf. Such specifications in turn lead, with the raised solution-annealing temperatures therefore to be applied, to an inadequate resistance to grain coarsening, which likewise has a very ductility-reducing effect. Furthermore, these measures are unable markedly to affect the full hardening in an improving manner. Very slow cooling rates here lead to the precipitation of rapidly coarsening chromium carbides on the austenite grain boundaries and to a partial transformation to a ferritic, pearlitic or bainitic microstructure.

The abovementioned weaknesses of the known and industrially accepted specifications are overcome as follows by a controlled matching of high contents of nitrogen and vanadium and minor admixtures of further alloy carbonitride formers such as Nb, Ta, Ti, Zr and Hf. The solubility of nitrogen and vanadium, if high contents thereof are alloyed in, is highly dependent on the temperature within a temperature range between 1300 and 600° C., where austenite is present as a stable or metastable matrix. This solubility gradient makes possible the partial dissolution and reprecipitation of a highly strength-effective high precipitation volume of cubic alloy VN nitrides. This precipitation type forms very uniformly in the appropriate temperature range and shows high resistance to coarsening. By means of controlled micro-alloying with Nb, Ta, Ti, Zr and Hf, the quantity of precipitation can be influenced and the stability of the particles against coarsening can be improved. As a consequence of this, extremely fine-grained structures can be produced during the forging treatment as a result of dissolution and reprecipitation reactions. The structures resulting from the forging treatment are, due to the stabilizing effect of primary nitrides, very resistant to grain coarsening and therefore permit controlled partial redissolution of primary nitrides during the solution-annealing treatment. In the course of controlled cooling with or without isothermal annealing in a medium temperature range or a thermomechanical treatment, nitride dispersions having a particle size of 3–50 nm and particle distances of between 5 and 100 nm can then be produced in a controlled manner. These affect the morphology and the dislocation density of the martensite being formed. The uncontrolled formation of coarse grain boundary precipitations or the formation of grain boundary films are suppressed by the nature and the kinetics for formation of these alloy nitrides. Bainite transformation is not observed in such nitrogen- and vanadium-rich systems. If the precipitation reaction is carried out after rapid cooling in the martensite during the tempering treatment, the inhomogeneity in the spatial distribution of the nitrides increases sharply and the susceptibility to film formation and/or agglomeration on the internal boundary layers of the tempered martensite becomes conspicuous. These diminish the achievable combinations of strength and ductility and the likewise achievable combination of creep rupture strength and creep toughness. In such specifications, there is therefore always a certain delayed cooling history and precipitation control before the martensitic phase transformation, which in the end leads to improved property combinations.

Some individual alloy compositions with a high nitrogen content of the fully martensitic 9–12% chrome steel type, which are inherently capable of precipitating vanadium nitrides in the manner described above, already exist. However, specifications which already demonstrate the optimum combination of the decisive methods of influencing the development of the microstructure in the specifications described here as the invention, are unknown. These include especially the control of the resistance to grain coarsening at very high solution-annealing temperatures, the possible increase in strength by the generation of an increased precipitation volume during very slow cooling histories and the very effective increase in the tempering stability as a consequence of these cooling processes.

The particularly preferred quantities for each element and the reasons for the selected alloying ranges are demonstrated below in their connection with the unusual heat treatment process.

Chromium

Chromium is an element which promotes the corrosion resistance and the full quenching and tempering ability. However, its ferrite-stabilizing effect must be compensated by the austenite-stabilizing effect of other elements such as Co, Mn or Ni. These reduce both the martensite start temperature and also the ferrite stability during the tempering treatment in a manner disadvantageous for producing a fully martensitic quenched and tempered microstructure or however, raise the alloying costs as in the case of Co. For this reason, Cr should not exceed 15% by weight. Less than 8% of chromium in turn not only reduces the corrosion resistance and oxidation resistance to an intolerable level, but also impairs the full hardenability in such a way that flexible precipitation of alloy nitrides before the martensitic phase transformation is greatly impaired. A particularly preferred range is 10 to 14% of chromium, especially 11 to 13% of chromium.

Manganese

Manganese is an element which very strongly promotes the full quenching and tempering ability, and it is very important for a flexible method of precipitating alloy nitrides before the martensitic phase transformation. 4% by weight is, however, sufficient for these purposes. Furthermore, Mn reduces the martensite start temperature and the ferrite stability during the tempering treatment, which leads to undesired microstructural forms in the fully quenched and hardened state. Particularly preferred ranges are up to 2.5%, 0.5 to 2.5% and 0.5 to 1.5% of manganese.

Nickel

Like Mn, nickel is an element which promotes the full quenching and tempering ability, but its effect in this respect is not as pronounced as that of manganese. On the other hand, its effect regarding the austenite stability at high solution-annealing temperatures is markedly greater than that of manganese. Moreover, its lowering effect on the martensite start temperature and the ferrite stability during tempering is not as great as that of manganese. A substitution of Ni by Mn depends on the flexibility of the precipitation reactions to be carried out before the martensitic phase transformation and on the level of the $A_{c1}$ temperature to be demanded for an optimum microstructure in the quenched and tempered state. However, the nickel content should not exceed 4% by weight, since otherwise the $A_{c1}$ falls to insufficiently low values. Particularly preferred ranges are up to 2.5%, 0.3 to 2.5%, 0.5 to 2.5%, up to 2% and up to 1.5% of nickel.

Since nickel and manganese act in a similar way, it is not so much the absolute quantitive proportions of each individual element but rather the total of the two quantitive proportions which is decisive. For the formation of a microstructure sufficiently close to the optimum, the total of Ni+Mn must not be more than 4% by weight. Particularly preferred ranges for Mn+Ni are not more than 3.0% by weight, Mn+Ni not more than 2.5% by weight, and Mn+Ni not more than 2.0% by weight and Mn+Ni=0.5% by weight to Mn+Ni=2.5% by weight.

Cobalt

Cobalt is the most important element for the optimization of a high austenite stability at high solution-annealing temperatures and of a high $A_{c1}$ temperature. Its quantitive proportion depends on the quantity of the ferrite-stabilizing elements Mo, W, V, Nb, Ta, Ti, Zr and Hf which are important for the strength. Above 15% by weight, the $A_{c1}$ temperature falls to no longer tolerable low values for a fully quenched and tempered microstructure. Preferred ranges are 5 to 15% by weight, 3 to 15% by weight, 1 to 10% by weight, 3 to 10% by weight, 1 to 8% by weight, 3 to 7% by weight and 1 to 6% by weight.

A particularly preferred range is 5–15% by weight of cobalt for alloys which, due to high molybdenum and tungsten contents, have a very high strength potential, and 1–10% by weight of cobalt for alloys on a low to medium strength level.

Low strength levels are approximately 700 to 850 MPa, medium levels are 850 to 1100 MPa and high levels are above 1100 MPa.

Molybdenum

Molybdenum can assume many functions which are important for the formation of the microstructure. Like chromium and manganese, it has a highly promoting effect with regard to the full quenching and tempering ability.

Furthermore, it can substantially contribute to a further increase in strength in solution or via precipitation reactions. High molybdenum contents, however, reduce the ductility due to the rapid coarsening of the intermetallic precipitation phases forming them. Its ideal content depends on the envisaged applications and the working temperatures of the respective components. However, molybdenum contents above 8% by weight reduce the ductility and the martensite start temperature to intolerable values. Preferred molybdenum contents are below 5% by weight, especially below 4 and 3% by weight.

Tungsten

Tungsten acts in a manner similar to molybdenum and the tungsten content should be below 6% by weight. Like that of molybdenum, its ideal content depends on the application and the working temperature of the respective components. Preferred tungsten contents are below 4% by weight, especially below 3% by weight.

Since molybdenum and tungsten act in a similar way, it is not so much the absolute proportions of each individual element but rather the total of the two quantitive proportions which is decisive. For the formation of a microstructure sufficiently close to the optimum, the total of Mo+W must not be more than 8% by weight. A particularly preferred range for high-strength alloys is Mo+W=3 to Mo+W=8% by weight, especially Mo+W=3 to Mo+W=5% by weight. A particularly preferred range for alloys in the low to medium strength class is Mo+W less than 4% by weight, in particular Mo+W less than 3% by weight and Mo+W=1 to Mo+W=3% by weight.

Vanadium

Vanadium is the alloying element which is the most important with respect to the setting of the best property combinations such as strength and ductility, creep rupture strength and creep ductility and also structural stability. Together with nitrogen, it assures a high resistance to grain coarsening at high solution-annealing temperatures and a strength-promoting high precipitation volume of VN alloy nitrides at relatively low precipitation temperatures. For a sufficiently good combination of a high grain-coarsening resistance with a strength-effective precipitation volume, however, at least 0.5% by weight is necessary. Increased vanadium contents make raised solution-annealing temperatures necessary. At vanadium contents above 1.5% by weight, the solution-annealing temperature to be applied for increased strengths rises to values which are no longer achievable industrially. A preferred range is 0.5 to 1% by weight of vanadium. An especially preferred range is 0.5 to 0.8% by weight of vanadium.

Nitrogen

Nitrogen with the accompanying element is a partner of vanadium for the formation of MN alloy nitrides. For a sufficiently good combination of a high grain-coarsening resistance with a strength-effective precipitation volume, at least 0.12% by weight is necessary. Like in the case of vanadium, the solution-annealing temperature to be applied for improved properties at nitrogen contents above 0.25% by weight rises to values which are no longer achievable industrially. A preferred range is 0.12–0.2% by weight of nitrogen. An especially preferred range is 0.12–0.18% by weight of nitrogen.

Carbon

Up to certain proportions, nitrogen can be substituted by carbon in the appropriate precipitations. In small quantities, carbon can contribute to an increased precipitation volume of alloy carbonitrides, without a decrease in the grain-coarsening resistance. Excess carbon increases the hardness of the quenched martensite. However, it promotes the formation of ductility-reducing precipitation phases such as $M_{23}C_6$ and $M_2(C,N)$ and also the formation of bainite at low cooling rates. Therefore, the carbon content should not exceed 0.1% by weight. A preferred range is less than 0.05% by weight of C. An especially preferred range is less than 0.03% by weight of C.

Niobium, tantalum, titanium, zirconium and hafnium

All these are alloying elements which, similarly to vanadium, can form alloy carbides of the MX type with nitrogen and carbon. In the absence of vanadium, the adjustable combination of a high grain-coarsening resistance with a strength-effective precipitation volume of MX alloy carbonitrides (M=Nb, Ta, Ti, Zr, Hf; X=C, N) is insignificantly small due to the unduly high affinity of these alloy carbonitride formers to N and C. Their action is predominantly based on the fact that, in small admixtures, they increase the grain-coarsening resistance during solution-annealing and the stability of primary V(N,C) nitrides to be precipitated by partial substitution of V. For an optimum effect, their contents should not exceed critical values, as a function of their affinity to the elements C and N. These are 0.15% by weight for Nb, 0.4% by weight for Ta, 0.04% by weight for Ti and 0.02% by weight for each of the elements Hf and Zr. These elements are capable, alone or in combination with one another, of effectively contributing to property improvements. The optimum combination depends on the mechanical properties to be established.

Apart from vanadium, niobium is the preferred element among the alloy nitride formers. Preferred maximum niobium contents are below 0.1% by weight. Highly preferred niobium contents are 0.02 to 0.1% by weight.

Boron

Boron is an element which promotes the full quenching and tempering ability and is therefore expedient for flexible precipitation reactions in the austenite before the martensitic phase transformation. Furthermore, it increases the coarsening resistance of precipitations in the tempered martensite. Since it tends to liquate and shows a high affinity to nitrogen, the boron content must be limited to 0.005% by weight.

Silicon

Silicon is an important deoxidation element and is therefore always found in steel. In solution, it can contribute to the strength of the steel and at the same time also increase the oxidation resistance. In large proportions, however, it has an embrittling effect. The weight proportion of silicon should therefore not exceed 0.3% by weight.

The alloying specifications according to the invention ensure a fully martensitic tempered microstructure which is generated by an extended quenching and tempering process. This comprises a solution-annealing treatment, a controlled rapid or slow cooling treatment with or without a thermomechanical treatment or isothermal tempering before the martensitic phase transformation, and a tempering treatment following the quenching to room temperature.

The solution-annealing treatment takes place at temperatures between 1150° C. and 1250° C. with holding times between 0.5 and 15 hours. The purpose of this solution-annealing treatment is the partial dissolution of alloy nitrides and alloy carbonitrides. Specially delayed cooling or isothermal tempering with or without a thermomechanical treatment, i.e. forming, in the quenching phase takes place at temperatures between 900 and 500° C. and can delay the entire quenching treatment by up to 1000 hours. The intention is to run precipitation processes in the austenitic base matrix in a controlled manner and to influence the martensitic phase transformation by already existing precipitation phases as well as a delayed microstructure aging during tempering and in operation. The tempering treatment is carried out at temperatures between 600 and 820° C. for annealing times of between 0.5 and 25 hours. The intention is a partial relief of the internal stresses generated by the martensitic phase transformation.

The mean grain diameter of the microstructure developing in the steel alloy due to the solution-annealing treatment does not grow beyond a value of 50 μm. In addition, the subsequent cooling down to the martensite start temperature affects the controlled running of the precipitation of vanadium-rich alloy nitrides or alloy carbonitrides, either by a thermomechanical treatment or by artificially delayed cooling.

EMBODIMENT EXAMPLE

Within the scope of the alloy specifications and heat treatment specifications formulated above, the alloy composition and heat treatments will be discussed below. The chemical composition of these alloys according to the invention, designated under AP, are represented in Table 1 and are compared therein with various comparison alloys. The AP alloys are delimited mainly by the high nitrogen and vanadium contents.

The AP alloys were smelted under a nitrogen partial pressure of 0.9 bar at temperatures between 1500 and 1600° C. The cast ingots were forged between 1230 and 1050° C. The heat treatments were carried out on forged plates having a thickness of 15 mm.

In the heat treatments for the mechanical tests, the solution-annealing was carried out at 1180° C. and lasted one hour. Subsequently to this, a furnace-controlled cooling at a cooling rate of 120° C./hour was carried out. Individual heat treatments are distinguished by isothermal ausageing. During this, the specimen is cooled after the solution-annealing to a moderate temperature which is significantly above the martensite start temperature, then held at this temperature for a certain period and subsequently cooled to room temperature. Such a heat treatment is diagrammatically represented in FIG. 1.

The individual heat treatments are designated T2, T4 and T5 below and have the following characteristics:

T2:

- Heating from 300 to 1180° C. at 450° C./hour
- Solution-annealing at 1180° C. for 1 hour
- Cooling in air to room temperature within 2 hours
- Tempering at 700° C. for 4 hours with subsequent cooling in air

T5:

- Heating from 300 to 1180° C. at 450° C./hour
- Solution-annealing at 1180° C. for 1 hour
- Cooling in the furnace to 700° C. at 120° C./hour
- Isothermal annealing at 700° C. for 120 hours
- Cooling in the furnace to room temperature at 120° C./hour
- Tempering at 700° C. for 4 hours with subsequent cooling in air

T6:

- Heating from 300 to 1180° C. at 450° C./hour
- Solution-annealing at 1180° C. for 1 hour
- Cooling in air to room temperature within 2 hours
- Tempering at 650° C. for 4 hours with subsequent cooling in air The heat treatments T2 and T6 differ from the heat treatment T5 by very high cooling rates in the quenching phase. In the heat treatment T5, longer isothermal annealing is additionally carried out before the martensitic phase transformation.

Referring now to the drawings, FIG. 1 diagrammatically shows the time/temperature history of the heat treatment T5.

Extensive investigations were carried out about the effect of the solution-annealing temperature on grain coarsening, about the effect of ausageing, preceding the martensitic phase transformation, on the martensite hardness and on the tempering stability. At the same time, the target strength and notch impact energy were tested for selected alloys, including novel heat treatments.

Figure 2:
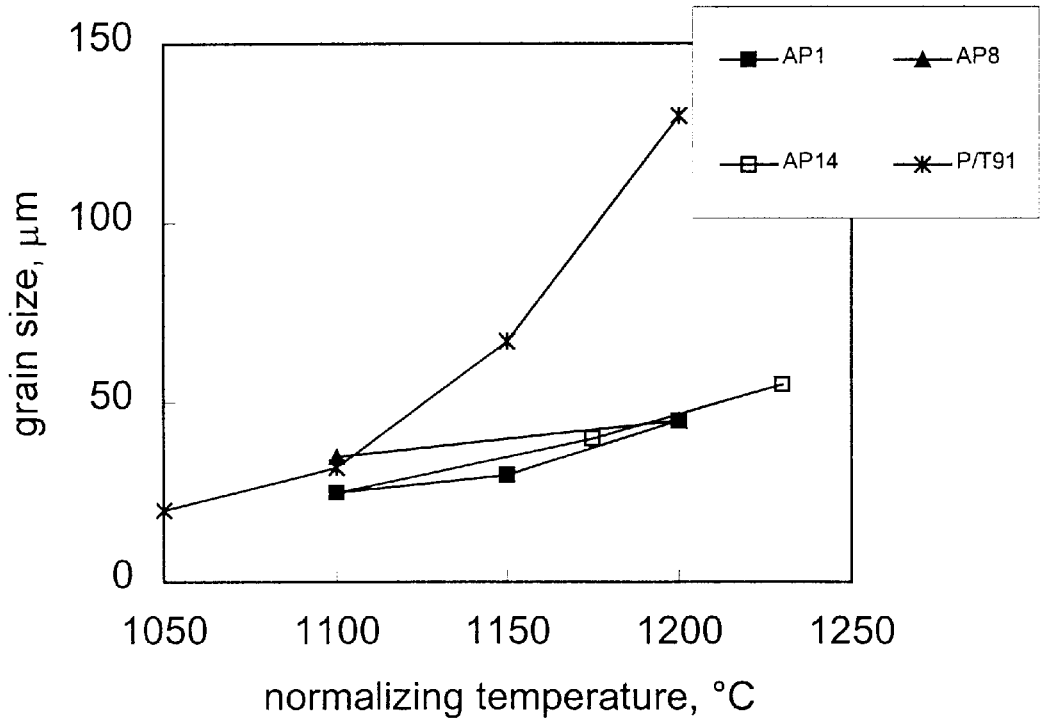
FIG. 2 shows the influence of the solution-annealing temperature on the grain size of alloys according to the invention compared with a known and newly launched alloy P/T91.

FIG. 2 shows the grain sizes which result from the application of different solution-annealing temperatures. In general, the grain size grows with increasing solution-annealing temperature. In the case of conventional 9–12% chrome steels, very pronounced grain coarsening starts above a solution-annealing temperature of 1100° C. In contrast with this, accelerated grain coarsening starts in the case of the alloys according to the invention only above 1200° C.

Figure 3:
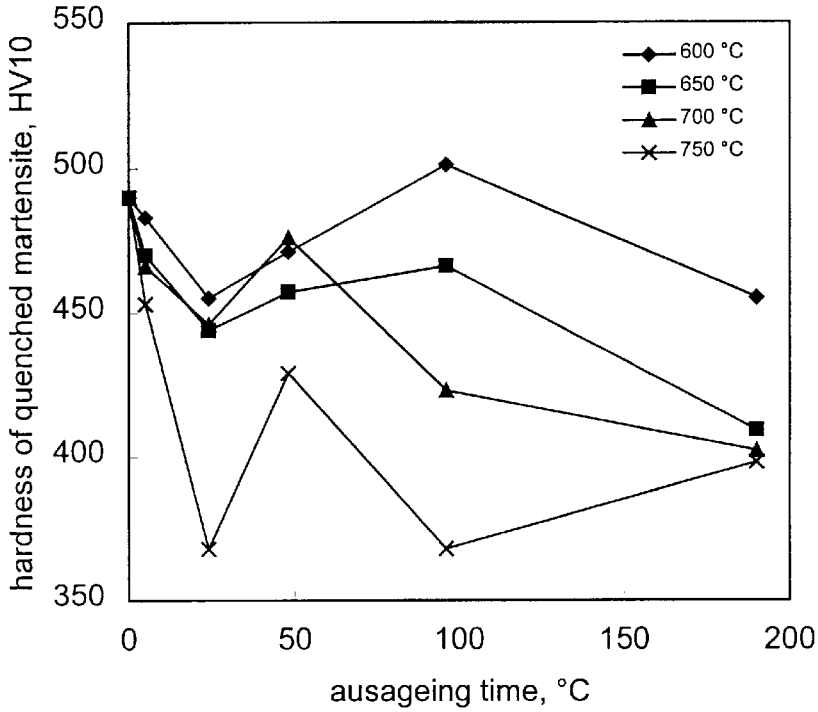
FIG. 3 shows the influence of an isothermal ausageing on the hardness of the subsequently quenched martensite; the temperature indication relates to that temperature at which the ausageing was carried out; the time axis indicates the duration of each ausageing carried out.

FIG. 3 shows, for the alloy AP11 according to the invention, the effect of isothermal annealing after the solution-annealing and before the martensitic phase transformation on the hardness of the quenched martensite. The individual specimens were each taken out of the furnace at different ausageing temperatures and ausageing times and quenched in water. The hardness at the time origin corresponds to the martensite hardness in the absence of ausageing, i.e. it corresponds to the solution-annealed (1200° C./1 hour) and directly quenched state. During ausageing, the quench hardness changes as a function of the ageing temperature and ageing time before the martensitic phase transformation. The hardness curve can here be non-monotonous. In principle, the quench hardnesses obtained at low ausageing temperatures are higher than those obtained at high ausageing temperatures. FIG. 3 shows, however, that an ausageing treatment for the purpose of new microstructural states can sufficiently be controlled in such a way that no major hardness losses are to be expected.

Figure 4:
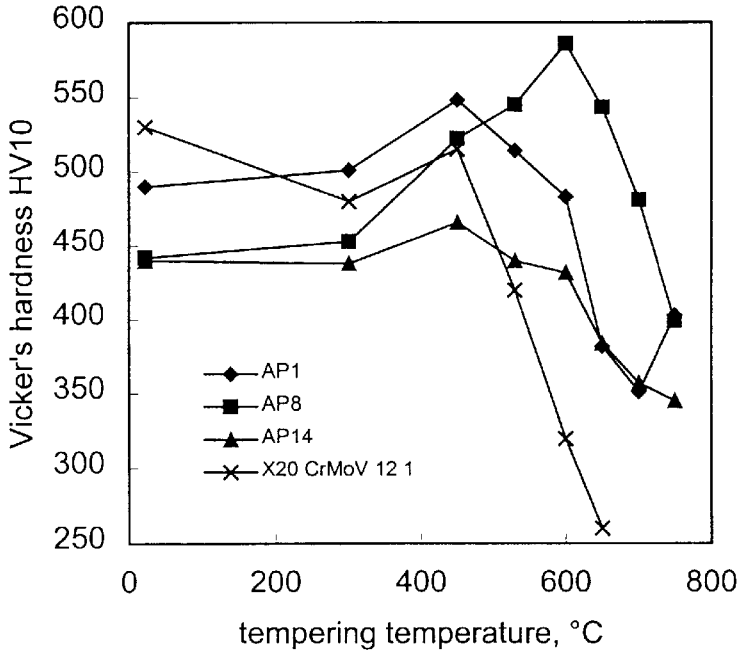
FIG. 4 shows tempering curves of alloys according to the invention compared with the known alloy X20 CrMoV 12 1.

FIG. 4 shows the tempering curves of three alloys according to the invention in comparison with the known alloy X20CrMoV121. In principle, higher tempering hardnesses are achieved in the case of the alloys according to the invention at tempering temperatures above 600° C., even at the same molybdenum content in the alloy (compare AP14 with TAF in Table 1). The influence of molybdenum becomes significant only at very high contents (AP8).

Figure 5:
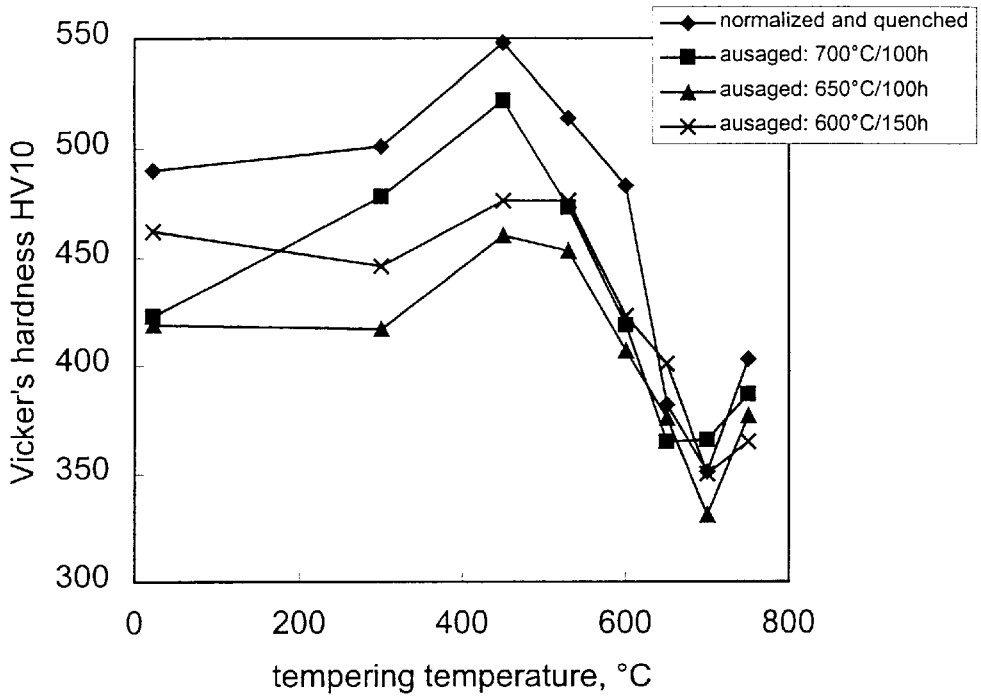
FIG. 5 shows the influence of excessive ausageing on the tempering curve of the alloy according to the invention AP1.

FIG. 5 shows the influence of prior over-ausageing on the tempering stability of an alloy AP11 according to the invention. Over-ausageing refers to microstructural states which, after ausageing, show a lower martensite hardness than the solution-annealed and directly quenched state. It becomes evident, however, that the differences diminish toward the industrially important tempering temperatures above 600° C. There are even states (ausaged: 600° C./150 hours) which show a higher hardness at a tempering temperature of 650° C. Ausageing can thus be exploited for setting higher strengths.

Figure 6:
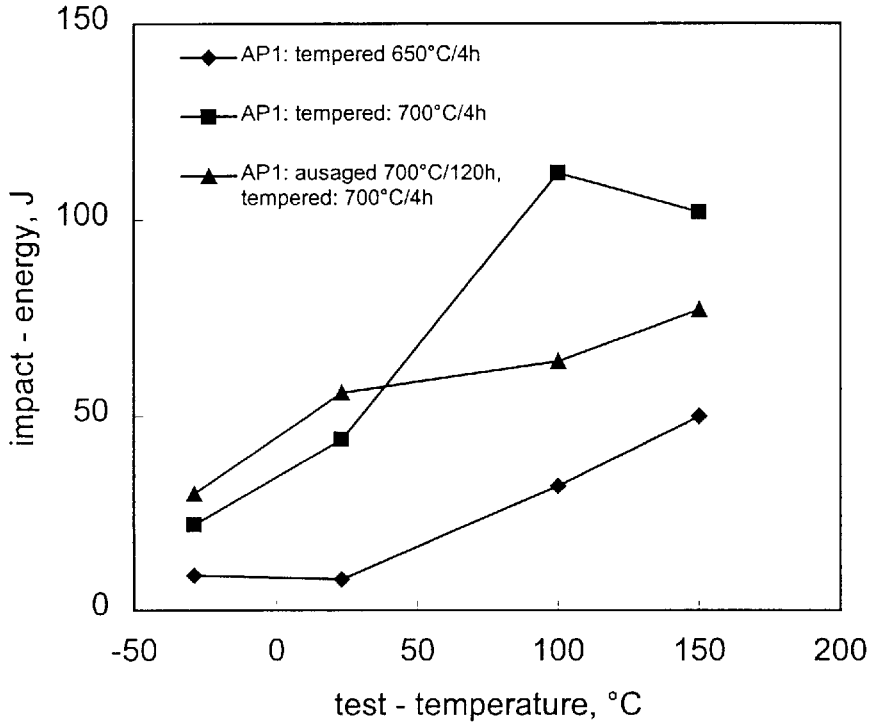
FIG. 6 shows the influence of ausageing on the notch impact energy and the transition temperature of the notch impact energy of the alloy according to the invention AP1.

FIG. 6 shows the influence of ausageing on the notch impact energy and of the transition temperature of the notch impact energy for the alloy AP1 according to the invention. In principle, the transition temperature of the notch impact energy falls with increasing tempering temperature and permits therefore the setting of higher notch impact energies. In the case of the alloy AP1, it becomes clear that over-ausageing does not lead to any substantial embrittlement.

Figure 7:
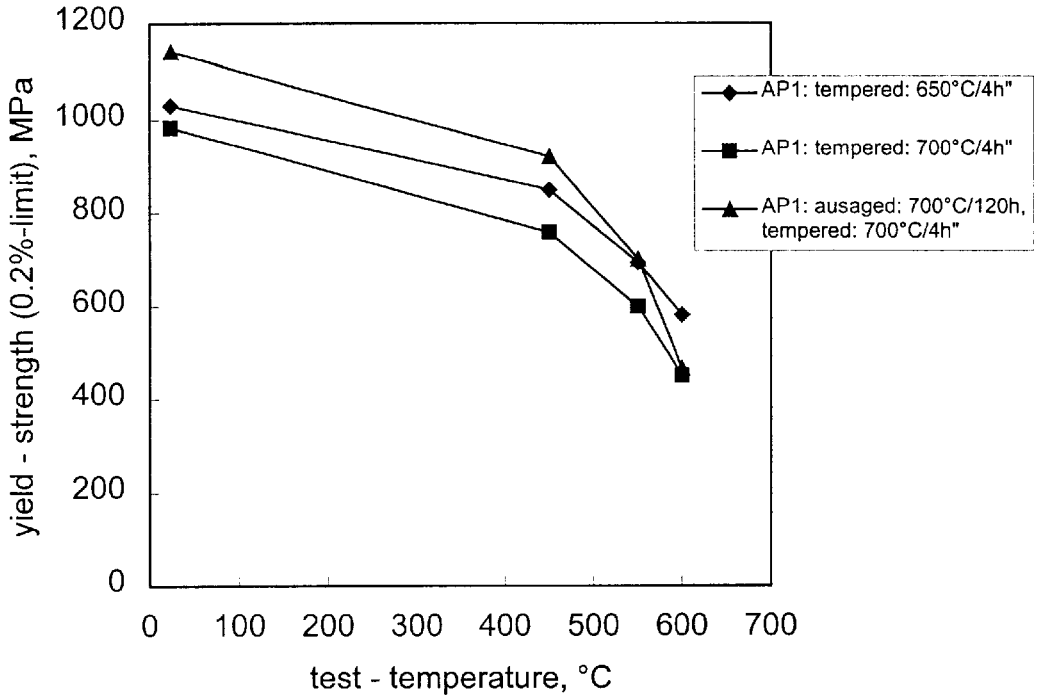
FIG. 7 shows the influence of ausageing on the yield strength of the alloy according to the invention AP1 at test temperatures between 23 and 600° C.

FIG. 7 shows the influence of ausageing on the yield strengths at test temperatures between 23° C. and 600° C. In principle, the yield strengths rise with falling tempering temperature. This means that the achievement of high strengths is, according to FIG. 6, at the expense of a markedly reduced notch impact energy. By contrast, over-ausageing of the alloy AP1 according to the invention leads to a marked increase in the yield strength up to a temperature of approximately 550° C., without being linked to an embrittlement.

Figure 8:
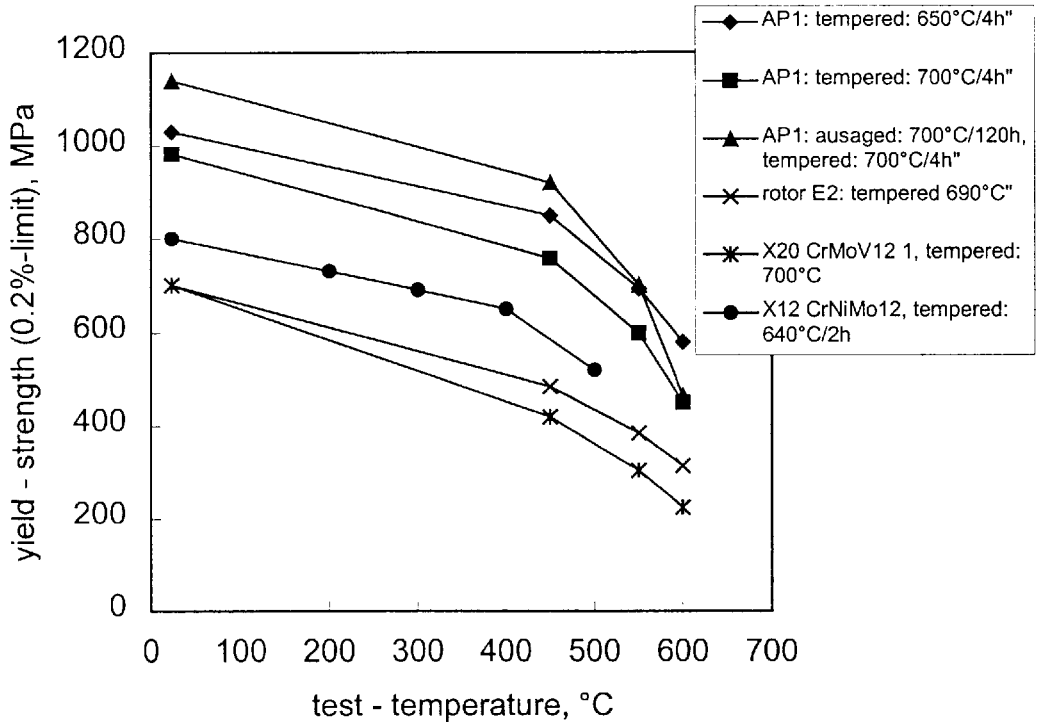
FIG. 8 shows a comparison of the yield points at elevated temperatures between the alloy according to the invention AP1 and known alloys.

FIG. 8 shows a comparison of the yield strengths between the alloy AP1 according to the invention and known alloys (X20CrMoV121, X12CrNiMo12) or the industrially newly launched alloy (X12CrMoWVNbN1111), the comparison values given being minimum standard values. The comparison shows that, at similar tempering temperatures, markedly higher yield strengths result for the example of the alloy AP1.

Figure 9:
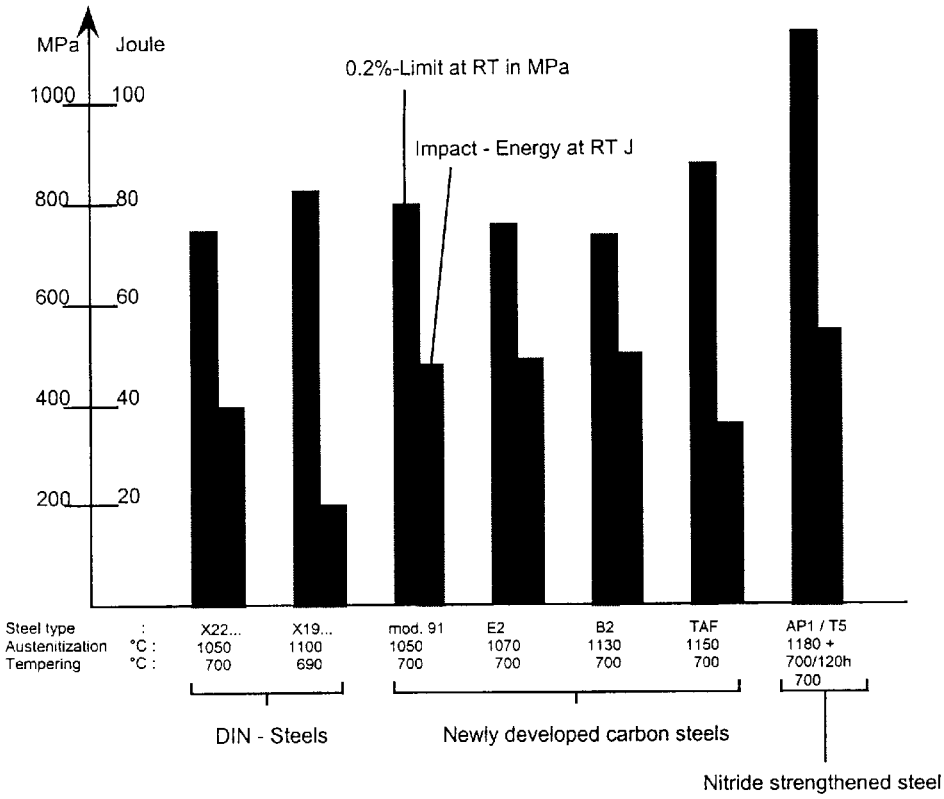
FIG. 9 shows a comparison of the notch impact energy and yield stress at room temperature between the alloy according to the invention AP1 and known alloys.

In FIG. 9, a comparison is made between a number of long-known and newly launched alloys with the alloy AP1 taken as an example. It can be seen that an alloy according to the invention of the AP1 type, produced taking account of optimized ausageing, makes possible a markedly better combination of notch impact energy and yield strength at room temperature, a well-optimized chemical composition according to the alloy AP1 taken as an example representing the decisive precondition for a positive benefit of ausageing.

Figure 10:
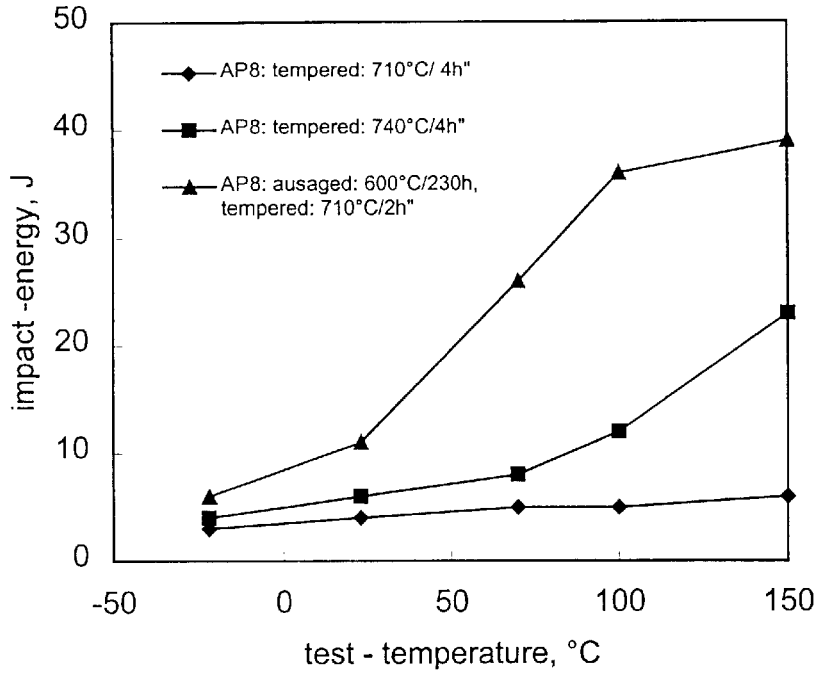
FIG. 10 shows the influence of ausageing on the notch impact energy and transition temperature of the notch impact energy of the alloy according to the invention AP8.

FIG. 10 shows the influence of ausageing on the notch impact energy and the transition temperature of the notch impact energy for an alloy AP8 according to the invention. This is characterized by a high molybdenum content (Table 1). In this way, an extremely high tempering stability can be achieved even above a tempering temperature of 600° C. (FIG. 4). On the other hand, this is linked with the disadvantage of pronounced embrittlement. Increasing the tempering temperature from 710 to 740° C. proves to have little effect here. On the other hand, for this alloy, the transition temperature of the notch impact energy can be considerably lowered by prior over-ausageing, even when retaining a tempering temperature of 710° C.

Figure 11:
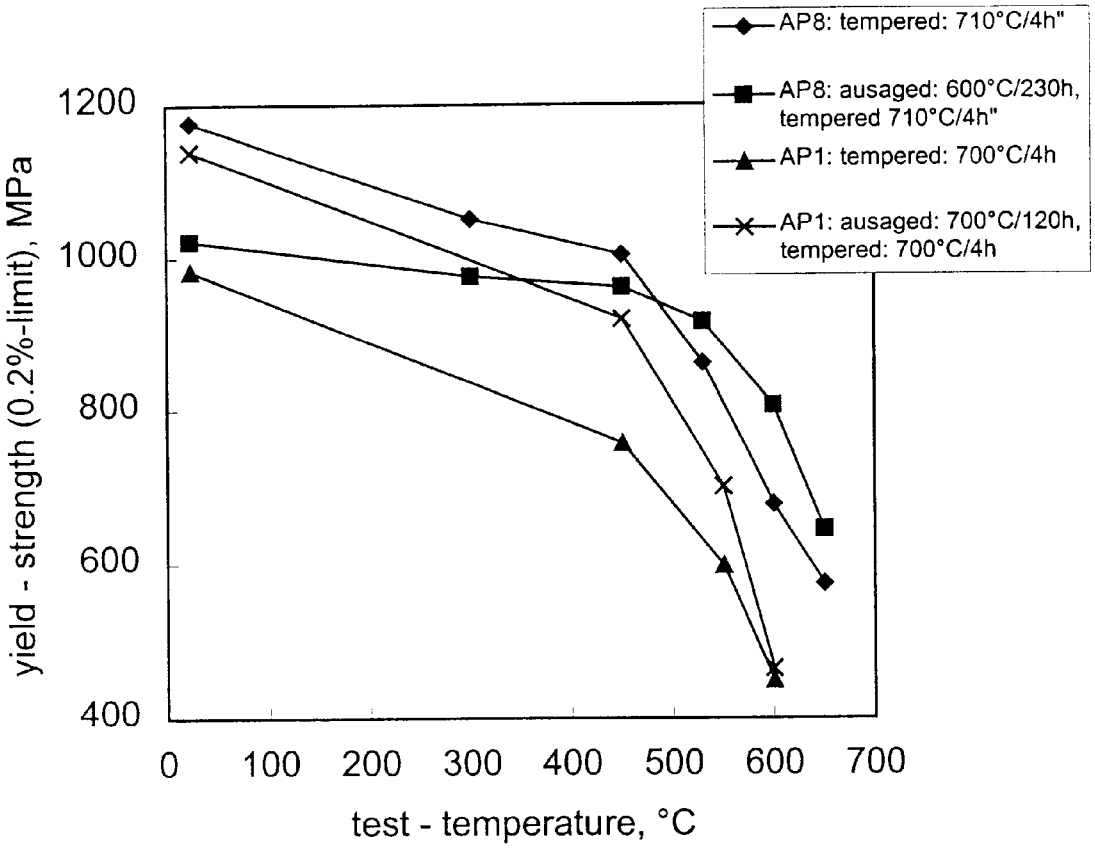
FIG. 11 shows the influence of the chemical composition (AP1, AP8) and of the temperature of excessive ausageing (700° C., 600° C.) on the trend of the yield point at elevated temperature between 23° C. and 650° C.

FIG. 11 shows, for the same alloy AP8, the influence of over-ausageing on the yield strength between 23° C. and 650° C. Although, in contrast to the alloy AP1, no increase in the yield strength at room temperature is obtained by the over-ausageing, a considerable increase in the high-temperature yield strength at temperatures above 500° C. is achieved by over-ausageing at lower ausageing temperatures. These comparisons prove that, by means of an optimum chemical composition—characterized by high nitrogen and vanadium contents—together with an optimization of the ausageing conditions it is possible to obtain improved combinations in the mechanical properties.

Obviously, numerous modifications and variations of the present invention are possible in the light of the above teachings. It is therefore to be understood that, within the scope of the appended claims, the invention may be practiced otherwise than as specifically described herein.

TABLE 1

Chemical composition of the alloys AP according to the invention and of the comparison alloys

| Alloy | Fe | Cr | Mn | Ni | Co | Mo | V | Ta | Nb | Ti | Zr | Hf | Si | C | N | B |
|---|---|---|---|---|---|---|---|---|---|---|---|---|---|---|---|---|
| AP1 | rem. | 12 | 1.96 | 0.49 | 10.3 | 1.51 | 0.69 | 0.013 | 0.04 | 0.040 | 0.005 | 0.005 | 0.18 | 0.031 | 0.15 | |
| AP2 | rem. | 12 | 0.54 | 2.04 | 10.2 | 1.51 | 0.71 | 0.014 | 0.04 | 0.0035 | 0.005 | 0.005 | 0.16 | 0.033 | 0.15 | |
| AP3 | rem. | 12 | 2.05 | 0.48 | 10.3 | 1.51 | 0.7 | 0.018 | 0.04 | 0.032 | 0.005 | 0.005 | 0.16 | 0.074 | 0.15 | |
| AP4 | rem. | 12 | 0.51 | 2.01 | 10.3 | 1.48 | 0.7 | 0.015 | 0.04 | 0.053 | 0.005 | 0.005 | 0.16 | 0.15 | 0.15 | |
| AP8 | rem. | 11.7 | 0.45 | 0.46 | 13.3 | 4.34 | 0.72 | <0.01 | 0.07 | 0.01 | 0.005 | 0.005 | 0.19 | 0.012 | 0.16 | |
| AP11 | rem. | 11.9 | 1.93 | 0.46 | 10.3 | 1.5 | 0.64 | <0.01 | 0.05 | 0.01 | 0.005 | 0.005 | 0.13 | 0.13 | 0.16 | |
| AP12 | rem. | 11.4 | 0.5 | 2.05 | 3.7 | 0.99 | 1.06 | <0.01 | 0.04 | <0.01 | 0.005 | 0.005 | 0.1 | 0.01 | 0.18 | |
| AP13 | rem. | 11.4 | 1.44 | 0.45 | 6.2 | 0.99 | 1.05 | <0.01 | 0.04 | <0.01 | 0.005 | 0.005 | 6.12 | 0.008 | 0.17 | |
| AP14 | rem. | 11.8 | 1.44 | 0.46 | 5.2 | 1 | 0.76 | <0.01 | 0.08 | <0.01 | 0.005 | 0.005 | 0.11 | 0.009 | 0.16 | |
| AP15 | rem. | 11.8 | 0.49 | 2.04 | 3.1 | 1 | 0.77 | <0.01 | 0.08 | <0.01 | 0.005 | 0.005 | 0.1 | 0.008 | 0.15 | |
| X22 | rem. | 12 | 0.5 | 0.55 | | 1 | 0.3 | | | | | | 0.2 | 0.022 | 0.05 | |
| X19 | rem. | 10.5 | 0.3 | 0.45 | | 0.7 | 0.18 | | 0.45 | | | | 0.3 | 0.19 | 0.05 | 0.0015 |
| P/T91 | rem. | 9 | 0.4 | 0.2 | | 1 | 0.2 | | 0.08 | | | | 0.15 | 0.1 | 0.05 | |
| E2 | rem. | 10 | 0.5 | 0.8 | | 1 | 0.2 | | 0.06 | | | | 0.04 | 0.12 | 0.05 | |
| B2 | rem. | 9 | 0.06 | 0.1 | | 1.5 | 0.25 | | 0.06 | | | | 0.12 | 0.18 | 0.01 | 0.01 |
| TAF | rem. | 10 | 0.9 | 0.1 | | 1.5 | 0.25 | | 0.18 | | | | 0.33 | 0.2 | 0.004 | 0.03 |

rem.: remainder
X22: X22CrMoV121
X19: X19CrMoVNbN111
P/T91: X10CrMoVNbN91
E2: X12CrMoWVNbN1011 (rotor steel E2)
B2: X18CrMoVNb91 (rotor steel B2)
TAF: X20CrMoVNbNB101

What is claimed is:

1. A fully martensitic quenching and tempering steel, essentially consisting of (measured in % by weight): 8 to 15% of Cr, 5 to 15% of Co, up to 4% of Mn, up to 4% of Ni, up to 8% of Mo, up to 6% of W, 0.5 to 1.5% of V, up to 0.15% of Nb, up to 0.04% of Ti, up to 0.4% of Ta, up to 0.02% of Zr, up to 0.02% of Hf, at most 50 ppm of B, up to 0.1% of C and 0.12–0.25% of N, the content of Mn+Ni being less than 4% and the content of Mo+W being less than 8%, the remainder being iron and usual impurities resulting from smelting.

2. A fully martensitic quenching and tempering steel as claimed in claim 1, wherein 0.5 to 1% of V and 0.12–0.2% of N, not more than 0.1% of Nb and/or 0.001 to 0.04% of Ti, and/or 0.001 to 0.4% of Ta, and/or 0.001 to 0.02% of Zr, and/or 0.001 to 0.02% of Hf are present.

3. A fully martensitic quenching and tempering steel as claimed in claim 1, wherein 0.5 to 0.8% of V and 0.12–0.18% of N are present, the niobium content is between 0.02 and 0.1%, and 0.001 to 0.04% of Ti, and/or 0.001 to 0.4% of Ta, and/or 0.001 to 0.02% of Zr, and/or 0.001 to 0.02% of Hf are present.

4. A fully martensitic quenching and tempering steel as claimed in claim 1 wherein 7 to 15% of Co is present.

5. A fully martensitic quenching and tempering steel as claimed in claim 2, wherein 10–14% of Cr, not more than 2.5% of Mn and not more than 2.5% of Ni are present, the sum of Ni+Mn not exceeding 2.5%, not more than 5% of Mo and not more than 4% of W being present and the sum of Mo+W being between 3 and 6%.

6. A fully martensitic quenching and tempering steel as claimed in claim 3, wherein 11–13% of Cr, not more than 1.5% of Mn and not more than 1.5% of Ni are present, the sum Ni+Mn not exceeding 2% and the sum of Mo+W being between 3 and 5%.

7. A fully martensitic quenching and tempering steel as claimed in claim 1, wherein 5 to 10% of Co is present.

8. A fully martensitic quenching and tempering steel as claimed in claim 2, wherein 10–14% of Cr and 5 to 8% of Co, not more than 2% of Mn and not more than 2% of Ni are present, the sum Ni+Mn being not more than 2.5%, not more than 3% of Mo and not more than 3% of W being present and the sum of Mo+W being not more than 3%.

9. A fully martensitic quenching and tempering steel as claimed in claim 3, wherein 11–13% of Cr, not more than 1.5% of Mn and not more than 1.5% of Ni are present, the sum Ni+Mn being not more than 2%.

10. A fully martensitic quenching and tempering steel as claimed in claim 1, wherein 6 to 15% of Co is present.

11. A fully martensitic quenching and tempering steel as claimed in claim 2, wherein 10–14% Cr and 5 to 10% of Co, not more than 2.5% of Mn and not more than 2.5% of Ni are present, the sum Ni+Mn being not more than 3%, not more than 4% of Mo and not more than 4% of W being present and the sum of Mo+W being not more than 4%.

12. A fully martensitic quenching and tempering steel as claimed in claim 3, wherein 11–13% of Cr and 5 to 7% of Co, not more than 3% of Mo and not more than 3% of W are present and the sum of Mo+W is not more than 3%.

13. A load bearing article made of the steel alloy as claimed in claim 1, the steel alloy having a fully martensitic quenched and tempered microstructure.

14. A heat treatment process for the steel alloy as claimed in claim 1, which comprises solution-annealing the alloy at temperatures between 1150° C. and 1250° C. with holding times of between 0.5 and 15 hours, cooling the alloy to room temperature and then tempering it for 0.5 to 25 hours at temperatures between 600° C. and 820° C.

15. The heat treatment process as claimed in claim 14, wherein the alloy, after the solution-annealing, is cooled below a temperature of 900° C. at cooling rates of less than 120° C./hour.

16. The heat treatment process as claimed in claim 14, wherein the alloy, directly after the solution-annealing treatment, is subjected at a temperature below 900° C. for between 5 and 500 hours to one or more isothermal annealing steps at one temperature or at different temperatures.

17. The heat treatment process as claimed in claim 14, wherein the heat treatment after the solution annealing is combined with a forming step.

18. A fully martensitic quenching and tempering steel as claimed in claim 1, wherein 0.6 to 1.5% of V is present.

19. A fully martensitic quenching and tempering steel as claimed in claim 1, wherein the steel contains nitride particles having sizes of 3 to 50 nm and spacing therebetween of 5 to 100 nm.

20. A fully martensitic quenching and tempering steel as claimed in claim 1, wherein the steel has a grain size of less than 50 $\mu$m.

* * * * *